US006114961A

United States Patent [19]

Denholm et al.

[11] Patent Number: 6,114,961

[45] Date of Patent: Sep. 5, 2000

[54] MULTI-TECHNOLOGY IN-LINE EAS DEACTIVATION APPARATUS

[75] Inventors: Scott Denholm, West Palm Beach, Fla.; Dan Cunneen, Waldwick, N.J.; Chris Brown, Fort Lauderdale, Fla.

[73] Assignee: Sensormatic Electronics Corporation, Boca Raton, Fla.

[21] Appl. No.: 09/439,259

[22] Filed: Nov. 12, 1999

[51] Int. Cl.[7] ..... G08B 13/14

[52] U.S. Cl. ..... 340/572.3; 340/676

[58] Field of Search ..... 340/572.3, 572.6, 340/676, 673

[56] References Cited

U.S. PATENT DOCUMENTS

| | | | |
|---|---|---|---|
| 4,510,489 | 4/1985 | Anderson et al. | 340/572 |
| 5,006,856 | 4/1991 | Benge et al. | 340/572 |
| 5,126,720 | 6/1992 | Zhou et al. | 340/572 |
| 5,341,125 | 8/1994 | Plonsky et al. | 340/572 |
| 5,376,923 | 12/1994 | Kindschy | 340/572 |
| 5,410,296 | 4/1995 | Montbriand et al. | 340/572 |
| 5,469,142 | 11/1995 | Bergman et al. | 340/572 |
| 5,973,606 | 10/1999 | Maitin et al. | 340/676 |

*Primary Examiner*—Jeffery A. Hofsass
*Assistant Examiner*—Sihong Huang
*Attorney, Agent, or Firm*—Rick F. Comoglio; Paul T. Kashimba

[57] ABSTRACT

A self-contained conveyor member including a plurality of EAS deactivators is adapted to connect in-line to an existing conveyor system for transporting goods at a manufacturer or distributor's site. The conveyor member has attached to it several commercially available EAS marker deactivators spaced apart to provide continuous coverage across the width of the conveyor and such that the deactivation field of each of the deactivators do not cause interference of the deactivation fields of the adjacent deactivators. EAS markers attached to articles being transported on the conveyor member will pass through at least one of the deactivation fields and will be deactivated. The deactivators selectively deactivate a variety of specific EAS markers such as RF and/or magnetomechanical EAS markers.

12 Claims, 5 Drawing Sheets

MULTI-TECHNOLOGY IN-LINE EAS DEACTIVATION APPARATUS

BACKGROUND OF THE INVENTION

1. Field of the Invention

This invention relates to electronic article surveillance (EAS) deactivators for rendering EAS markers inactive, and more particularly to EAS deactivators for deactivating EAS markers on a conveyor.

2. Description of the Related Art

It is customary in the electronic article surveillance industry to apply EAS markers to articles of merchandise. Detection equipment is positioned in interrogation zones at store exits to detect attempts to remove goods with attached active markers from the store premises, and to generate an alarm in such cases. When the articles of merchandise are purchased, the EAS markers are deactivated to prevent detection when exiting the store. There are several types of EAS systems commercially available, including magnetomechanical, RF, harmonic, and microwave.

An example of a magnetomechanical system is disclosed in U.S. Pat. No. 4,510,489. Markers used in magnetomechanical systems are formed of a magnetostrictive element contained in an elongated housing in proximity to a bias magnetic element. The magnetostrictive element is a ribbon-shaped length of a magnetostrictive amorphous material fabricated such that it is resonant at a predetermined frequency when the bias element has been magnetized to a certain level. At the interrogation zone, a suitable oscillator provides an AC magnetic field at the predetermined frequency, and the marker mechanically resonates at this frequency upon exposure to the field. The detection equipment detects the resulting signal radiated by the marker.

In a magnetomechanical EAS marker the bias element functions as a control element. If it is desired to deactivate the magnetomechanical marker, the magnetic condition of the bias element is changed so that the bias element no longer provides the magnetic bias field required for the marker to resonate at the predetermined frequency expected by the detection equipment.

RF EAS systems utilize markers that include a tuned LC resonant circuit. The RF marker responds to an RF interrogation frequency that matches the marker's resonant frequency. The marker's resonant frequency signal can then be detected by detection equipment. RF markers of this type are disclosed in U.S. Pat. No. 5,006,856. To deactivate RF markers, part of the LC resonant circuit can include a fusible member or a breakdown member that, when exposed to high level RF radiation, destroys the LC resonant circuit or changes the LC resonance outside of the range expected by the detection equipment In retail applications, EAS systems require active markers on merchandise within the retail store. To reduce the in-store burden of attaching EAS markers at the retail locations, the EAS markers described above can be connected to, attached to, placed inside, or in some way associated with articles of merchandise by the article manufacturer or distributor. There is a plurality of different EAS systems presently in use including both RF and magnetomechanical EAS systems. It is desirable for both RF EAS and magnetomechanical EAS markers to be attached to each article by the manufacturer or distributor so that articles arriving at a given store can be detected by the type of EAS system in-use in the store.

When articles are purchased, the EAS markers associated with each article of merchandise will be deactivated.

However, the store will have either an RF system or a magnetomechanical system, and, depending on which type of system the store is using, either the RF marker or the magnetomechanical marker will still be active. A patron could thus leave a first store, which utilizes one of the two types of EAS systems and enter a second store, which utilizes the other of the two EAS systems, and set off an alarm.

Presently, there are bulk deactivators available that can deactivate bulk quantities of RF or magnetomechanical EAS markers that are typically used by a manufacturer or distributor. However, bulk deactivators are expensive and can only deactivate one type of EAS marker. What is needed is an economical way to selectively deactivate the appropriate magnetomechanical or RF EAS marker attached to articles at the manufacture's or distributor's site so that when the articles arrive at the retail store, only the EAS markers associated with the store's EAS system type will be active.

BRIEF SUMMARY OF THE INVENTION

In a first aspect of the present invention a self-contained conveyor member including a plurality of EAS deactivators can be adapted to connect in-line to an existing conveyor system for transporting goods at a manufacturer or distributor's site. The conveyor member has attached to it several commercially available EAS marker deactivators spaced apart to provide continuous coverage across the width of the conveyor. Continuous coverage means complete coverage so that there are no areas on the conveyor member that an EAS marker can move without being deactivated. The deactivators are spaced apart so that the deactivation field of each of the deactivators does not cause substantial interference of the deactivation fields of the adjacent deactivators, while providing continuous deactivation coverage across the width of the conveyor member. Substantial interference of the deactivation field could result in a degradation of the field that would result in missed or incomplete deactivation of an EAS marker. EAS markers attached to articles being transported on the conveyor member will pass through at least one of the deactivation fields and will be deactivated.

Each of the deactivators can include an EAS detector that will detect an EAS marker passing through the conveyor member. Detection of an EAS marker by a detector will trigger the deactivation field associated with the detector to deactivate the detected EAS marker. The spacing of the deactivators includes providing continuous detection coverage across the width of the conveyor while preventing interference between the detection field of each detector. Interference between detection fields could result in missed detection of an EAS marker on the conveyor member.

The deactivators can be selected to all be magnetomechanical deactivators, RF deactivators, or other type deactivators for deactivation of magnetomechanical, RF, or other EAS markers, respectively. Alternately, a combination of deactivators such as magnetomechanical and RF can both be utilized on the conveyor member.

In a second aspect of the present invention, several magnetomechanical and several RF EAS deactivators can be utilized on the conveyor member. The deactivators are spaced apart as described above to prevent interference between deactivation fields while providing continuous deactivation coverage for both magnetomechanical EAS marker deactivation and RF EAS marker deactivation across the width of the conveyor. A manual or automatic selector switch is used to selectively switch between the magnetomechanical and RF deactivators.

The magnetomechanical and RF deactivators can include magnetomechanical and RF EAS marker detectors, respectively. The spacing apart of the detectors as described above includes preventing interference between detection fields while providing continuous detection coverage for both magnetomechanical EAS marker detection and RF EAS marker detection. The deactivation field of each deactivator is triggered by the detection of an EAS marker on the conveyor member.

A selector switch can be manually or automatically controlled to selectively activate the magnetomechanical or the RF deactivators. Alternately, the selector switch can activate the magnetomechanical and the RF deactivators simultaneously to deactivate both types of EAS markers if desired.

Accordingly, it is an object of the present invention to provide a plurality of EAS marker deactivators for use on a conveyor member to provide continuous EAS deactivation coverage across the width of the conveyor member.

It is another object of the present invention to provide continuous deactivation coverage across the width of a conveyor member that is selectable between different types of EAS marker deactivations such as magnetomechanical EAS marker deactivation and RF EAS marker deactivation.

It is yet another object of the present invention to provide continuous deactivation coverage across the width of a conveyor member for both magnetomechanical EAS marker deactivation and RF EAS marker deactivation.

Other objectives, advantages, and applications of the present invention will be made apparent by the following detailed description of the preferred embodiment of the invention.

DETAILED DESCRIPTION OF THE INVENTION

Figure 1:
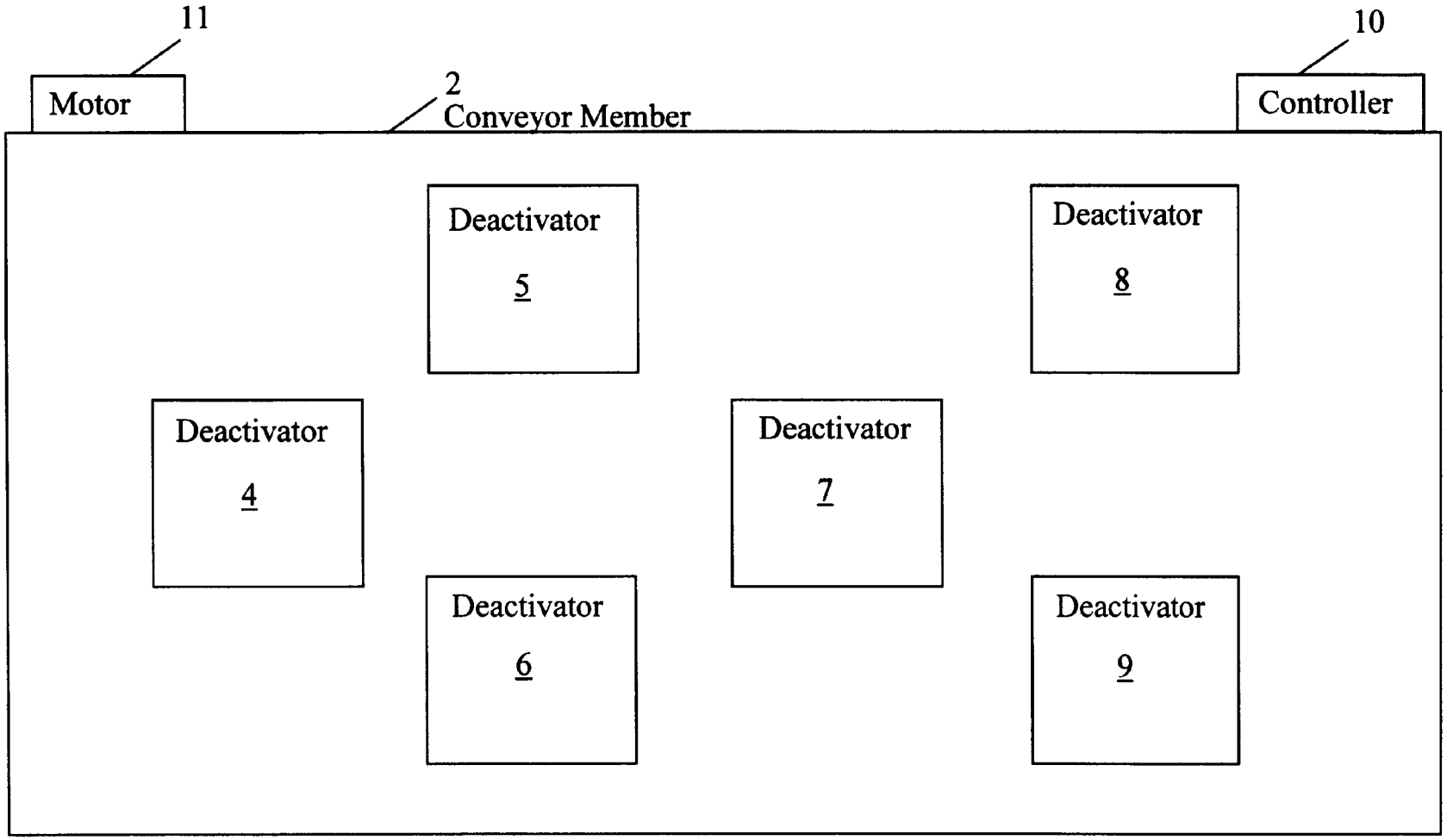
FIG. 1 is a top plan view of the preferred embodiment of the present invention.

Referring to FIG. 1, a preferred embodiment of the present invention is illustrated with conveyor member 2 having EAS deactivators 4, 5, 6, 7, 8, and 9 attached to conveyor member 2 in the pattern illustrated. Conveyor member 2 can be attachable in-line with a user's conveyor 13 at a suitable location. Of the deactivators 4 through 9, three are RF EAS deactivators and three are magnetomechanical EAS deactivators. Deactivators 4 through 9 are attached to conveyor member 2 in a manner that does not hinder operation of conveyor belt 3, shown in FIG. 2. The RF deactivators are conventional RF EAS deactivators available from various RF EAS suppliers such as Security Source, Boston, Mass. The magnetomechanical EAS deactivators are conventional deactivators available from Sensormatic Electronics Corporation, Boca Raton, Fla., under the brand name Rapid Pad™.

The deactivators 4 through 9 are disposed in a spaced apart manner that prevents interference between adjacent deactivators and provides continuous deactivation coverage across the entire width of conveyor member 2. Each deactivator generates a deactivation field that can be a magnetic and/or electric field. An EAS marker on conveyor 2 will move through a deactivation field of at least one deactivator 4 through 9 to be deactivated. Interference between adjacent deactivators could prevent deactivation of an EAS marker that moves through the interference region of the deactivation fields. If the deactivators are spaced too far apart, an EAS marker could move between adjacent deactivators and not move through a deactivation field or move through a portion of a deactivation field that is too weak for complete deactivation. Spacing the deactivators too far apart would also unnecessarily increase the overall length of conveyor member 2. Conveyors substantially wider or narrower than conveyor member 2 can utilize more or fewer than three deactivators, respectively, of each type of deactivator.

Each of the deactivators includes the capability to detect an associated RF or magnetomechanical EAS marker, which triggers the generation of the associated deactivation field. For detection of EAS markers, each deactivator generates a detection field. Interference between adjacent deactivators could prevent detection of an EAS marker that moves through the interference region of the detection fields. If the deactivators are spaced too far apart, an EAS marker could move between adjacent deactivators and not move through a detection field so that no deactivation field is triggered. Alternately, an EAS marker could pass through a detection field, triggering the generation of a deactivation field, but move through a portion of the deactivation field too weak for complete deactivation. Therefore, deactivators 4 through 9 are spaced as close as possible to each other while preventing interference between adjacent detection and deactivation fields.

In a first embodiment, deactivators 4, 5, and 6 are first type deactivators and deactivators 7, 8, and 9 are second type deactivators. In a second embodiment, deactivators 4, 5, and 9 are first type deactivators and deactivators 6, 7, and 8 are second type deactivators. In a third embodiment, deactivators 4, 8, and 9 are first type deactivators and deactivators 5, 6, and 7 are second type deactivators. The first and second type deactivators are RF and magnetomechanical deactivators, respectively, or alternately are magnetomechanical and RF deactivators, respectively.

Controller 10 controls switching between the RF deactivators and the magnetomechanical deactivators, and selectively turns on one type of deactivator or the other type depending on what type of EAS markers are desired to be deactivated. Alternately, controller 10 can turn on both types of deactivators simultaneously. In one embodiment, controller 10 is manually controlled by a user to turn-on the selected group of deactivators. Alternately, controller 10 can be sensor, logic, or computer controlled. Conveyor member 2 can be powered with motor 11 driving conveyor belt 3 in conventional manner.

Figure 2:
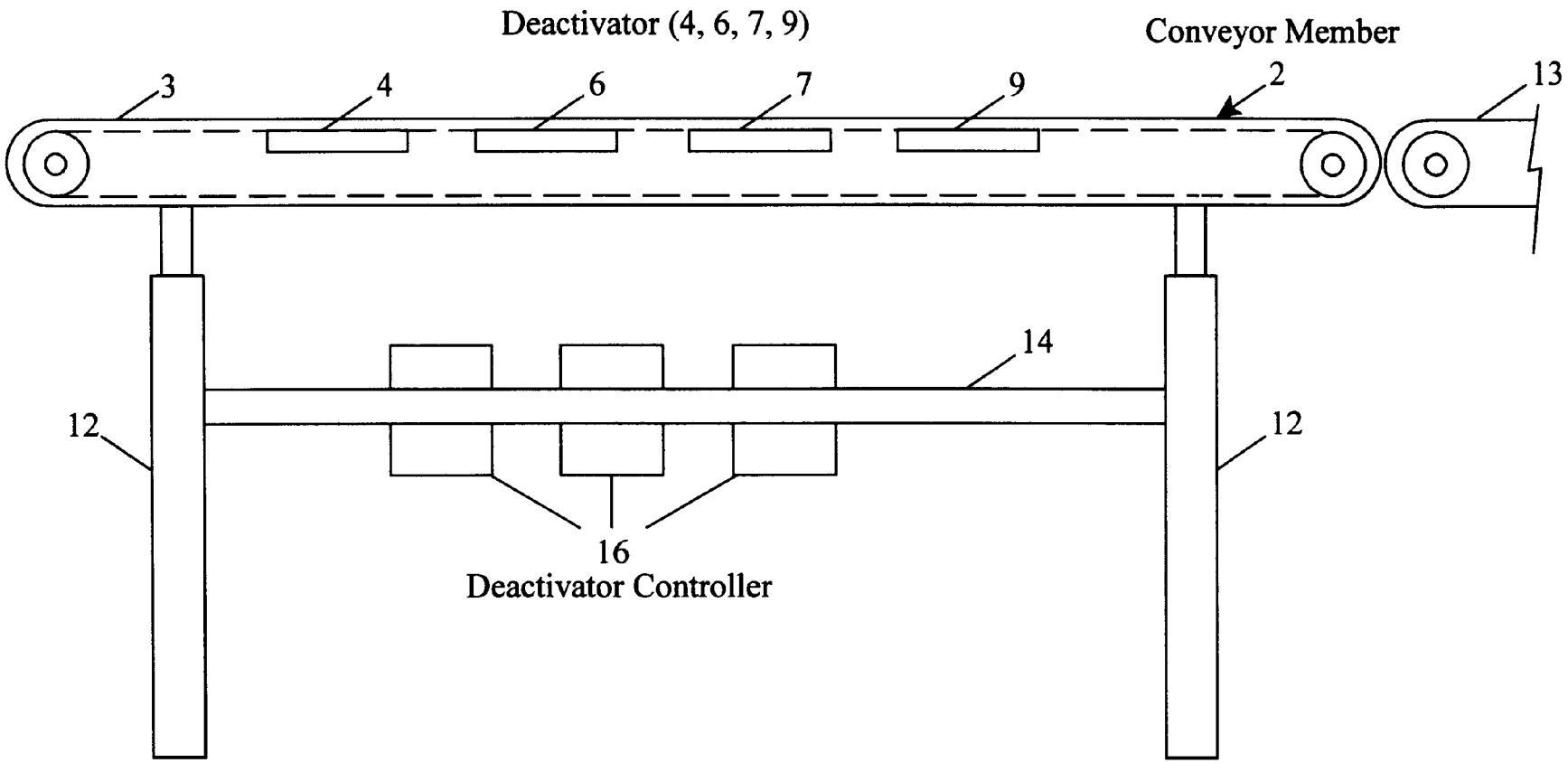
FIG. 2 is a side elevational view of that of FIG. 1.

Referring to FIG. 2, a side view of conveyor member 2 is illustrated showing legs 12 to enable conveyor member 2 to be free standing. Cross-member 14 provides a mounting arrangement for a plurality of deactivator controllers 16. Deactivator controllers 16 house electronic control components for the deactivators and are conventional. Conveyor member 2 can be mounted in an alternate manner such as suspended from a ceiling. If suspended, legs 12 and cross-member 14 would not be necessary. Deactivator controllers 16 can be mounted in an alternate fashion. Operation of conveyor member 2 in-line with a user's conveyor will vary with each installation and is within the knowledge of those of ordinary skill in the art. Attachment of deactivators 4 through 9 to conveyor member 2 is within the knowledge of those of ordinary skill in the art.

Figure 3:
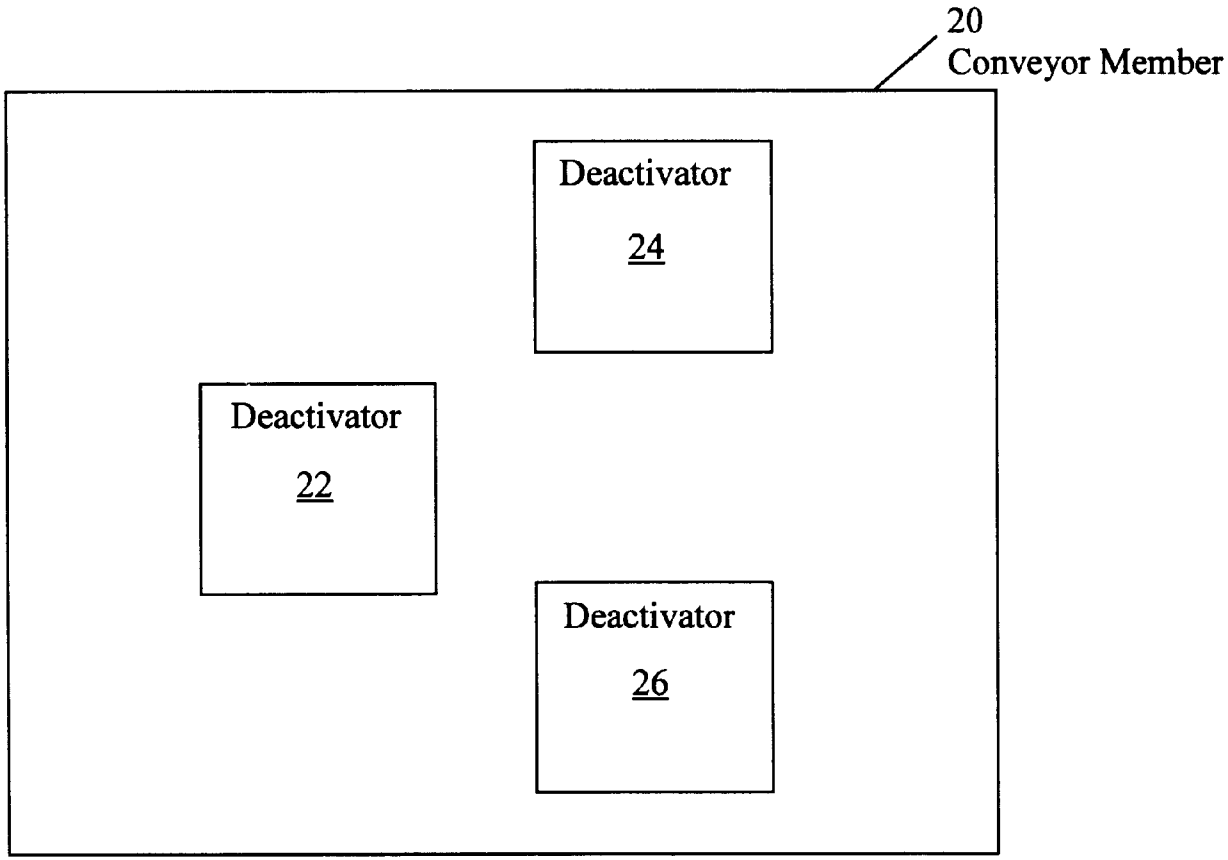
FIG. 3 is a top plan view of an alternate embodiment of the present invention.

Referring to FIG. 3, an alternate embodiment of the present invention is illustrated showing a conveyor member 20 having a plurality of deactivators 22, 24, and 26. Deactivators 22 through 26 are either RF deactivators or magnetomechanical deactivators, and are spaced apart according to the discussion above for the preferred embodiment of the invention.

Figure 4:
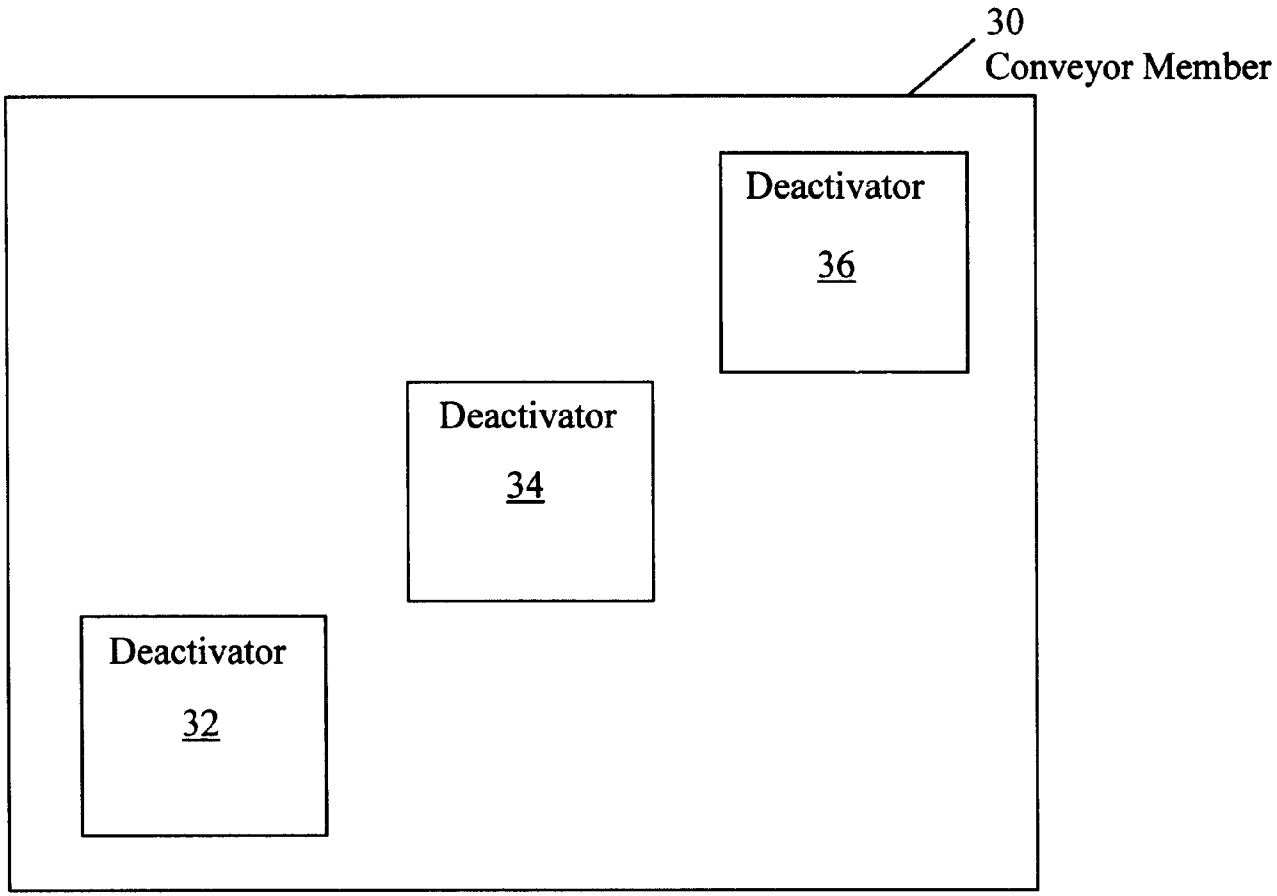
FIG. 4 is a top plan view of an alternate embodiment of the present invention.

Referring to FIG. 4, an alternate embodiment of the present invention is illustrated showing a conveyor member 30 having a plurality of deactivators 32, 34, and 36. Deactivators 32 through 36 are either RF deactivators or magnetomechanical deactivators, and are spaced apart according to the discussion above for the preferred embodiment of the invention.

The embodiments of the present invention illustrated in FIGS. 3 and 4 are economical deactivators that can be utilized in place of bulk deactivators by manufacturers and/or distributors to deactivate EAS markers prior to shipment to the retailer or seller. EAS technologies other than RF and magnetomechanical are also known that could be adapted and incorporated into the present invention, and which are contemplated herein.

Figure 5:
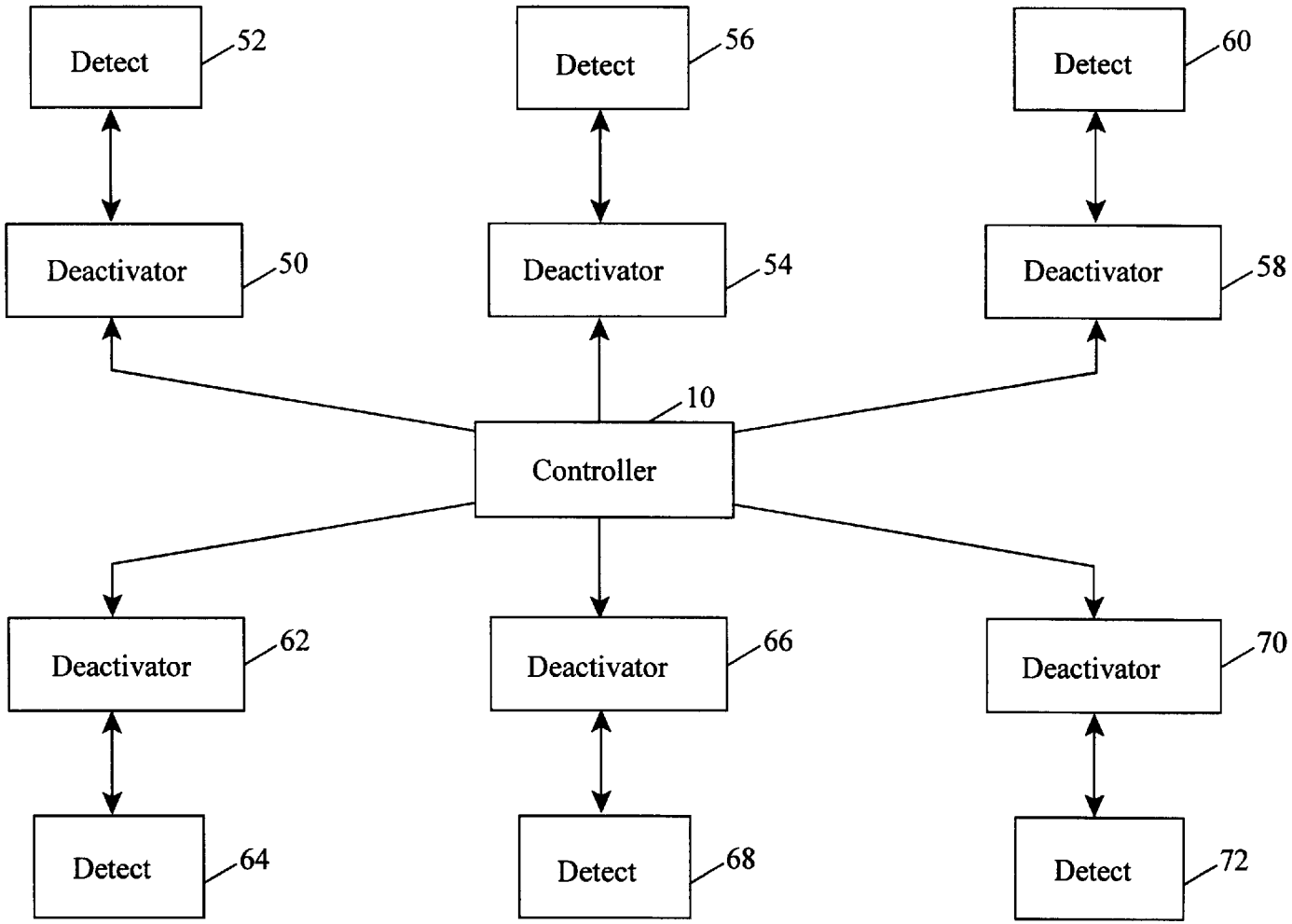
FIG. 5 is a block diagram of one embodiment of the present invention.

Referring to FIG. 5, as stated hereinabove, controller 10 controls switching of the deactivators. Deactivators 50, 54, 58, 62, 66, and 70, which can include EAS detectors 52, 56, 60, 64, 68, and 72, respectively, can be RF, magnetomechanical, or other type deactivators, as described above. Six deactivators are illustrated in FIG. 5, but controller 10 can control fewer or greater than 6 deactivators according to the particular embodiment of the invention selected to be implemented.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. An apparatus for deactivating EAS markers associated with articles on a conveyor, comprising:

a conveyor member:

a plurality of deactivation means for deactivation of an EAS marker, each of said deactivation means including a deactivation field, each of said deactivation means attached to said conveyor member in a spaced relationship with each other to prevent substantial interference between each said deactivation field of each of said deactivation means, wherein the EAS marker associated with an article disposed on the conveyor will be deactivated by passing through said deactivation field of at least one of said deactivation means, and, each of said plurality of deactivation means includes detecting means for detecting the EAS marker, said deactivation field of each of said deactivation means being turned on by said detecting means, said detecting means including a detection field, said spaced relationship of said deactivation means including preventing substantial interference between said detection field of said detecting means of each of said deactivation means, wherein the EAS marker associated with the article disposed on the conveyor will be detected by passing through the detection field of said detecting means of at least one of said deactivation means.

2. The apparatus of claim 1 wherein said plurality of deactivation means deactivates magnetomechanical EAS markers, and said detection means detects magnetomechanical EAS markers.

3. The apparatus of claim 1 wherein said plurality of deactivation means deactivates RF EAS markers, and said detection means detects RF EAS markers.

4. The apparatus of claim 1 wherein said plurality of deactivation means includes means for deactivation of magnetomechanical EAS markers and means for deactivation of RF EAS markers, and said detection means includes means for detection of magnetomechanical EAS markers and means for detection of RF EAS markers.

5. An apparatus for deactivating EAS markers associated with articles on a conveyor, comprising:

a conveyor member;

a plurality of deactivation means for deactivation of an EAS marker, each of said deactivation means including a deactivation field, each of said deactivation means attached to said conveyor member in a spaced relationship with each other to prevent substantial interference between each said deactivation field of each of said deactivation means, wherein the EAS marker associated with an article disposed on the conveyor will be deactivated by passing through said deactivation field of at least one of said deactivation means, wherein said plurality of deactivation means deactivates RF EAS markers.

6. The apparatus of claim 5 wherein said plurality of deactivation means includes means for deactivation of magnetomechanical EAS markers and means for deactivation of RF EAS markers.

7. An apparatus for deactivating magnetomechanical EAS markers and RF EAS markers associated with articles on a conveyor, comprising:

a conveyor member;

a plurality of first deactivation means for deactivation of a magnetomechanical EAS marker, each of said first deactivation means including a first deactivation field, each of said first deactivation means attached to said conveyor member in a first spaced relationship with each other to prevent substantial interference between each said first deactivation field of each of said first deactivation means, wherein the magnetomechanical EAS marker associated with an article disposed on the conveyor will be deactivated by passing through the first deactivation field of at least one of said first deactivation means;

a plurality of second deactivation means for deactivation of an RF EAS marker, each of said second deactivation means including a second deactivation field, each of said second deactivation means attached to said conveyor member in a second spaced relationship with each other to prevent substantial interference between each said second deactivation field of each of said second deactivation means, wherein the RF EAS marker associated with the article disposed on the conveyor will be deactivated by passing through the second deactivation field of at least one of said second deactivation means; and, switching means for selectively turning on said plurality of first deactivation means and said plurality of second deactivation means.

8. The apparatus of claim 7 wherein each of said plurality of first deactivation means includes first detecting means for detecting the magnetomechanical EAS marker, said first deactivation field of each of said first deactivation means being turned on by said first detecting means, said first detecting means including a first detection field, said spaced relationship of said first deactivation means including preventing substantial interference between said first detection field of said first detecting means of each of said first deactivation means, wherein the magnetomechanical EAS marker associated with the article disposed on the conveyor will be detected by passing through said first detection field of said first detecting means of at least one of said first deactivation means; and, each of said plurality of second deactivation means includes second detecting means for detecting the RF EAS marker, said second deactivation field of each of said second deactivation means being turned on by said second detecting means, said second detecting means including a second detection field, said spaced relationship of said second deactivation means including preventing substantial interference between said second detection field of said second detecting means of each of said second deactivation means, and preventing interference with said first detection field of said detection means of each of said first deactivation means, wherein the RF EAS marker associated with the article disposed on the conveyor will be detected by passing through said second detection field of said second detecting means of at least one of said second deactivation means.

9. The apparatus of claim 7 wherein said switching means turns on said first deactivation means and said second deactivation means simultaneously.

10. The apparatus of claim 7 wherein said conveyor member is adapted to operate in-line with the conveyor to form part of the conveyor.

11. An apparatus for deactivating EAS markers associated with articles on a conveyor, comprising:

a conveyor member;

a plurality of deactivation means for deactivation of an EAS marker, each of said deactivation means including a deactivation field, each of said deactivation means attached to said conveyor member in a spaced relationship with each other to prevent substantial interference between each said deactivation field of each of said deactivation means, wherein the EAS marker associated with an article disposed on the conveyor will be deactivated by passing through said deactivation field of at least one of said deactivation means, and, wherein said plurality of deactivation means includes means for deactivation of at least two different types of EAS markers, each of said at least two different types of EAS marker being selected from the group containing magnetomechanical EAS markers, RF EAS markers, harmonic EAS markers, and microwave EAS markers.

12. The apparatus of claim 11 wherein said conveyor member is adapted to operate in-line with the conveyor to form part of the conveyor.

* * * * *